US007071875B2

(12) United States Patent
Sugimoto et al.

(10) Patent No.: US 7,071,875 B2
(45) Date of Patent: Jul. 4, 2006

(54) ANTENNA AND RADIO FREQUENCY MODULE COMPRISING THE SAME

(75) Inventors: Noriyasu Sugimoto, Konan (JP); Naoki Otaka, Komaki (JP); Daisuke Nakata, Nagoya (JP); Susumu Wakamatsu, Gifu (JP); Takashi Kanamori, Kasugai (JP); Toshikatsu Takada, Konan (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 262 days.

(21) Appl. No.: 10/446,162

(22) Filed: May 28, 2003

(65) Prior Publication Data

US 2004/0001031 A1 Jan. 1, 2004

(30) Foreign Application Priority Data

May 28, 2002 (JP) ..... 2002-153733

(51) Int. Cl.
*H01Q 1/38* (2006.01)

(52) U.S. Cl. ..... 343/700 MS; 343/895

(58) Field of Classification Search ..... 343/700 MS, 343/702, 895

See application file for complete search history.

(56) References Cited

U.S. PATENT DOCUMENTS 5,986,609 A * 11/1999 Spall ..... 343/702
6,304,219 B1 10/2001 Rothe ..... 343/700 MS
6,329,962 B1 12/2001 Ying ..... 343/895
6,351,241 B1 2/2002 Wass ..... 343/702
6,433,745 B1 * 8/2002 Nagumo et al. ..... 343/700 MS
6,452,548 B1 * 9/2002 Nagumo et al. ..... 343/700 MS
6,734,828 B1 * 5/2004 Shor ..... 343/795
2001/0002823 A1 6/2001 Ying ..... 343/700 MS
2002/0000940 A1 1/2002 Moren et al. ..... 343/702
2002/0030626 A1 3/2002 Naguno et al. ..... 343/700 MS
2003/0210188 A1 * 11/2003 Hebron et al. ..... 343/700 MS

* cited by examiner

*Primary Examiner*—Hoang V. Nguyen
(74) *Attorney, Agent, or Firm*—Stites & Harbison PLLC; Ross F. Hunt, Jr.

(57) ABSTRACT

A multiple band antenna comprising: a dielectric substrate; and a plurality of antenna elements being formed of each a conductor on a same face of the dielectric substrate and provided in a one-to-one correspondence with frequency bands to operate the frequency bands, wherein each of the antenna elements has an open end as one end and is connected at an opposite end to a feeder line and comprises a narrow part being placed on a side of the open end and formed by line with a narrow wide and a wide part being placed on a side of the feeder line and having a wider width than the narrow wide of the narrow part, the narrow part is turned in order in substantially the same direction as a width direction of the wide part, to form a meander shape, and the antenna elements have the wide parts joined in one piece forming a predetermined angle with each other so as to share a part of the wide parts.

15 Claims, 6 Drawing Sheets

ANTENNA AND RADIO FREQUENCY MODULE COMPRISING THE SAME

FIELD OF THE INVENTION

This invention relates to a multiple band antenna and in particular to an antenna suited for use with a radio communication device in a wireless LAN (local area network); a mobile telephone, Bluetooth, etc.

BACKGROUND OF THE INVENTION

At present, in a wireless LAN, a communicating system using a 2.4-GHz band and a communicating system using a 5-GHz band are available and also in a mobile telephone, a communication system using a 0.8-GHz band and a communication system using a 1.5-GHz band are available.

Formerly, one communication device was able to communicate with another only in one frequency band system. In recent years, however, one communication device that can communicate in two frequency bands systems has also been developed.

Such a communication device that can communicate in a plurality of frequency bands needs to use a multi-band antenna capable of transmitting and receiving radio waves of a plurality of frequency bands.

Various types of multi-band antennas are available. For example, "Zukai idoutuushinyou antenna system" written by FUJIMOTO Kyouhei, YAMADA Yoshihide, and TUNEKAWA Kouichi, published by Sougou Denshi Shuppansha discloses an antenna shown in FIG. 6.

FIG. 6 is a plan view to show an example of a multi-band antenna in a related art. An antenna 100 has two antenna elements 104 and 106 made of conductors placed in parallel on a dielectric substrate 102. Power is supplied to the antenna elements 104 and 106 in parallel through a feeder line 108 divided into two branches at an intermediate point from a signal source (not shown).

SUMMARY OF THE INVENTION

The antenna 100 shown in FIG. 6 has the two antenna elements 104 and 106 placed in parallel as described above. However, if the two antenna elements are thus placed in parallel, the characteristics of the antenna elements are degraded because of electromagnetic interaction between the antenna elements; this is a problem. Specifically, between the two antenna elements 104 and 106, electromagnetic wave flows interfere with each other and the center frequencies deviate from the intended range and the impedances deviate from the intended range, so that the gains of the antenna elements are reduced.

On the other hand, to decrease such electromagnetic interaction, the distance between the two antenna elements 104 and 106 maybe set to a large distance. However, if the distance is thus set to a large distance, the dimension of the antenna 100 in the width direction (X direction) thereof becomes large; this is a problem.

Therefore, the invention is intended for solving the above-described problems in the related arts and it is an object of the invention to provide an antenna for making it possible to decrease electromagnetic interaction between antenna elements without upsizing the dimension of the antenna.

To the end, according to the invention, there is provided a multiple band antenna, including:

a dielectric substrate; and a plurality of antenna elements being formed of each a conductor on the same face of the dielectric substrate and provided in a one-to-one correspondence with frequency bands to operate with the frequency bands, characterized in that each of the antenna elements has an open end as one end and is connected at an opposite end to a feeder line and includes a narrow part being placed on the open end side and formed like a line with a comparatively narrow wide and a wide part being placed on the feeder line side and having a wider width than the narrow part, that the narrow part is turned in order in substantially the same direction (preferably plus or minus 10°) as the width direction of the wide part, forming a meander shape, and that the antenna elements have the wide parts joined in one piece forming a predetermined angle with each other so as to share a part of the wide parts.

Thus, in the antenna of the invention, the antenna elements share a part of the wide parts, so that the dimension of the antenna in the width direction thereof can be lessened accordingly. Since the antenna elements are placed forming the predetermined angle θ with each other, the electromagnetic interaction between the antenna elements can be decreased and the characteristics of the antenna elements are not impaired. The wide part is formed by line having wider width than that of line forming the narrow part, and is located between the narrow part and the feeder line. The narrow part is formed by line having narrower width than that of line forming the wide part, and has an open end as one end and is connected at an opposite end to the wide part.

In the antenna of the invention, the predetermined angle indicates 0° or more and 180° or less; preferably the predetermined angle is 0° or more and 130° or less, more preferably the predetermined angle is 0° or more and 90° or less, further more preferably the predetermined angle is 0° or more and 50° or less, and still further preferably the predetermined angle is 5° or more and 50° or less.

Thus, the angle between the antenna elements is set to a value in the range of 5° to 50°, so that a wide bandwidth can be achieved as the signal band of the high-frequency side, for example.

In the antenna of the invention, the dielectric substrate is a print circuit board for mounting parts.

The dielectric substrate on which the antenna elements are formed may be an antenna-dedicated substrate, but may be a print circuit board for mounting parts on which any other circuitry for communication is constructed, for example.

According to the invention, there is provided a radio frequency module for transmitting and receiving a signal, the radio frequency module including any of the antennas described above.

Thus, any of the antennas described above can be applied to the radio frequency module for transmitting and receiving a signal.

DESCRIPTION OF REFERENCE NUMERALS

Figure 1:
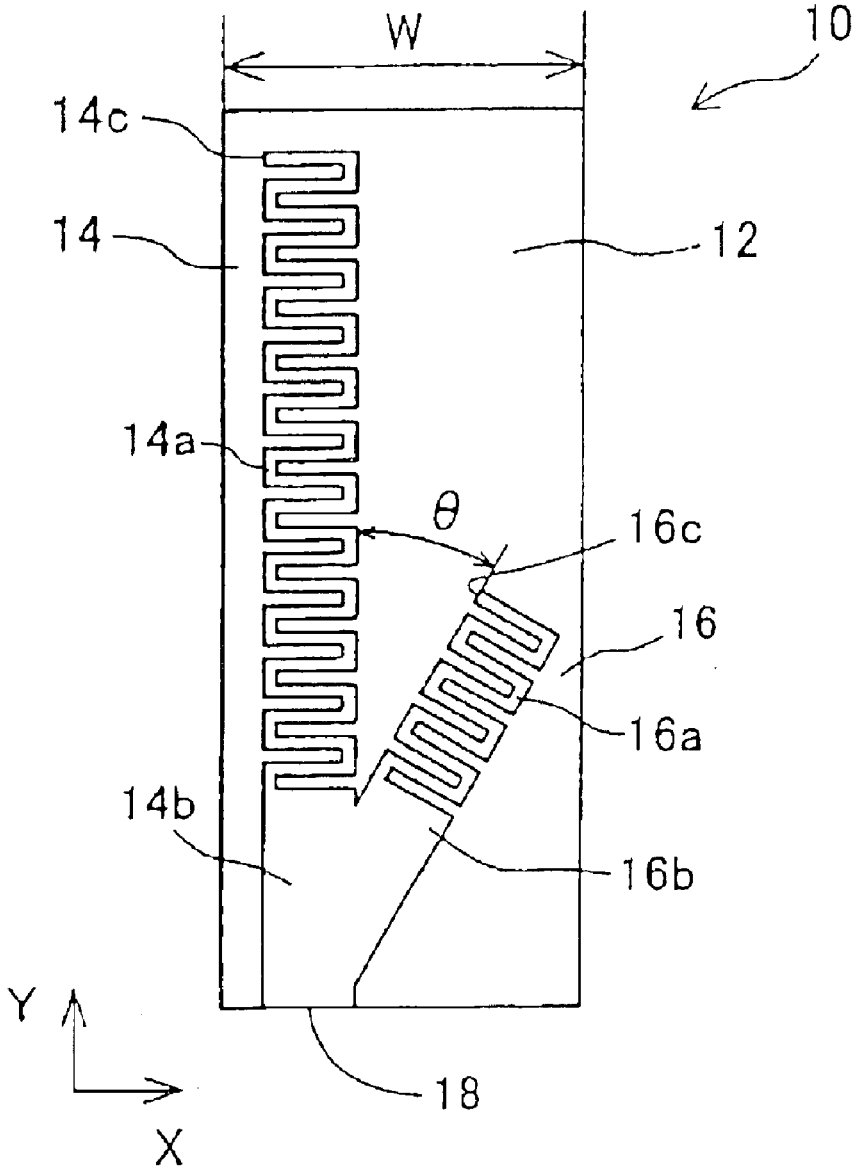
FIG. 1 is a plan view to show an antenna as a first embodiment of the invention.

10, 10', 10": Antenna
12, 12', 12": Dielectric substrate
14, 16, 20: Antenna element
14*a*, 16*a*, 20*a*: Narrow part
14*b*, 16*b*, 20*b*: Wide part
14*c*, 16*c*, 20*c*: Open end
50: Radio frequency module
52: Base band IC
54: RFIC
56, 60: Low-noise amplifier
58, 62: Power amplifier
64, 68: BPF
66, 70: LPF
72, 74: Switch
76: Diplexer
100: Antenna
102: Dielectric substrate
104, 106: Antenna element
108: Feeder line

DETAILED DESCRIPTION OF THE INVENTION

Referring now to the accompanying drawings, there are shown preferred embodiments of the invention. FIG. 1 is a plan view to show an antenna as a first embodiment of the invention.

An antenna 10 of the embodiment is used with a radio communication device in a wireless LAN, etc., for example, and operates with two frequency bands of a 2.4-GHz band and a 5-GHz band. The antenna adopts a monopole type in which the line length is one-quarter wavelength.

As shown in FIG. 1, the antenna 10 of the embodiment includes a dielectric substrate 12 formed preferably of ceramics such as aluminum oxide and glass ceramic, and a first antenna element 14 and a second antenna element 16 formed of a conductor such as Ag, Ag—Pt, Ag—Pd, Cu, Au, W, Mo and Mn and an alloy of at least two of them, on the surface of the dielectric substrate 12.

The first antenna element 14 is able to operate with the 2.4-GHz band and the second antenna element 16 is able to operate with 5-GHz band. The first, second antenna element 14, 16 has an open end 14*c*, 16*c* as one end and a feeding end 18 as an opposite end. The open end 14*c*, 16*c* side is linear with a comparatively narrow width, forming a narrow part 14*a*, 16*a*. On the feeding end 18 side, a wide part 14*b*, 16*b* wider than the narrow part 14*a*, 16*a* is formed for impedance matching.

The embodiment is first characterized by the fact that the first antenna element 14 is placed almost along the length direction (Y direction) of the dielectric substrate 12, that the second antenna element 16 is inclined at a predetermined angle θ with respect to the first antenna element 14, and that the first antenna element 14 and the second antenna element 16 have the wide parts 14*b* and 16*b* joined in one piece so as to share a part of the wide parts 14*b* and 16*b*.

Thus, the first and second antenna elements 14 and 16 share a part of the wide parts 14*b* and 16*b*, so that the wide part occupation area can be lessened accordingly and thus dimension W of the antenna 10 in the width direction (X direction) thereof can be lessened.

As the wide parts 14*b* and 16*b* are joined in one piece, the feeding end 18 is also made common to the first and second antenna elements 14 and 16 and a feeder line (not shown) is connected to the common feeding line 18. That is, power is supplied from a signal source (not shown) via the feeder line (not shown) through the feeding end 18 to the first and second antenna elements 14 and 16. Thus, the feeding end 18 is also made common, thereby eliminating the need for branching the feeding line connected to the feeding end 18 and circumventing complication of the configuration of the feeding line.

The second antenna element 16 is inclined at the predetermined angle θ with respect to the first antenna element 14, so that the electromagnetic interaction between the first and second antenna elements 14 and 16 can be decreased and the characteristics of the first and second antenna elements 14 and 16 are not impaired.

Figure 2:
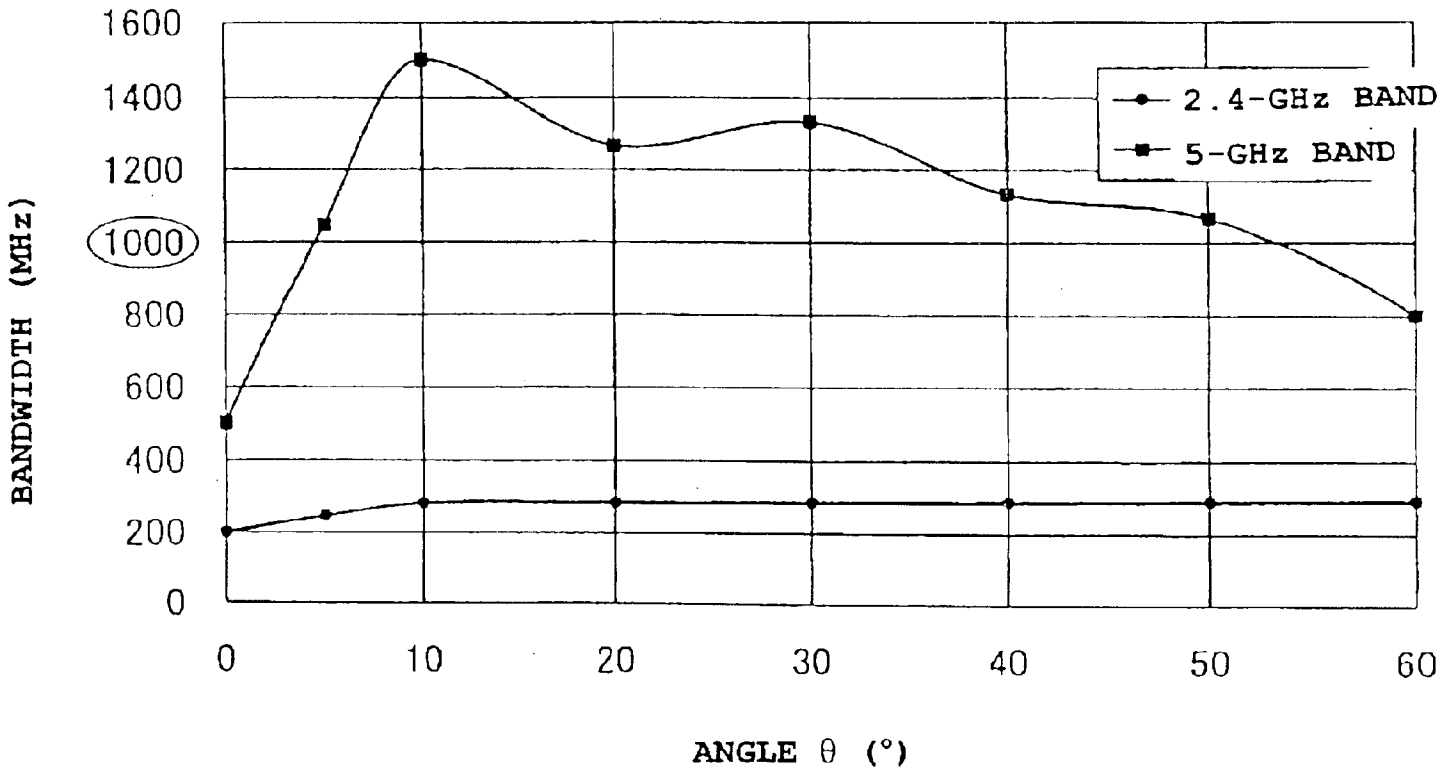
FIG. 2 is a graph to show the relationship between angle θ between first and second antenna elements 14 and 16 and the bandwidth of a signal that can be transmitted and received in the antenna 10 in FIG. 1.

FIG. 2 is a graph to show the relationship between the angle θ between the first and second antenna elements 14 and 16 and the bandwidth of a signal that can be transmitted and received (VSWR=2) in the antenna 10 in FIG. 1. In FIG. 2, the horizontal axis indicates the angle θ (°) between the first and second antenna elements 14 and 16 and the vertical axis indicates the signal bandwidth (MHz). Black dots indicate the case where a signal in the 2.4-GHz band corresponding to the first antenna element 14 is transmitted and received, and black squares indicate the case where a signal in the 5-GHz band corresponding to the second antenna element 16 is transmitted and received.

As seen in FIG. 2, the bandwidth of the signal in the 2.4-GHz band that can be transmitted and received does not much change with change in the angle θ, but the bandwidth of the signal in the 5-GHz band that can be transmitted and received largely changes with change in the angle θ.

Generally, in the 5-GHz band of the high-frequency side, particularly a wide band is required as the bandwidth; specifically an about 20% of relative bandwidth (bandwidth/center frequency) is required.

Then, in the embodiment, the angle θ between the first and second antenna elements 14 and 16 is set to a value in the range of 5° to 50°. Accordingly, 1000 MHz or more can be provided as the bandwidth in the 5-GHz band of the high-frequency side. What value in the range of 5° to 50° to set is determined by making a comparison between the degree of decrease in the electromagnetic interaction between the first and second antenna elements 14 and 16 and the degree of shortening the dimension of the antenna 10.

The embodiment is second characterized by the fact that each of the narrow parts 14*a* and 16*a* of the first and second antenna elements 14 and 16 forms a meander shape. Specifically, the narrow part 14*a*, 16*a* starts at the corresponding wide part 14*b*, 16*b* and projects along the length direction of the wide part from the wide part and is bent toward the width direction of the wide part. Then, the narrow part 14*a*, 16*a* is turned in the opposite direction in the width direction and likewise is turned in the opposite direction in the width direction in order and the whole of the narrow part 14*a*, 16*a* extends along the length direction. Finally, the narrow part 14*a*, 16*a* arrives at the corresponding open end 14*c*, 16*c* as the end point. The meander shape may be formed by a curbed line, a straight line or a jagged line, or a combination thereof.

Thus, the narrow parts 14*a* and 16*a* of the first and second antenna elements 14 and 16 are made each such a meander shape, whereby the lengths of the antenna elements 14 and 16 in the length directions thereof can be shortened. The narrow part 14*a*, 16*a* is turned in the width direction of the wide part 14*b*, 16*b* in order, thereby forming the meander shape, so that the wide part 14*b*, 16*b* can function sufficiently as the impedance matching part, as mentioned above.

Further, the embodiment is third characterized by the fact that the first and second antenna elements 14 and 16 are formed on the same face of the dielectric substrate 12.

The first and second antenna elements 14 and 16 are thus formed on the same face of the dielectric substrate 12, whereby the manufacturing process can be simplified as compared with the case where the first and second antenna elements 14 and 16 are formed on different planes such as the surface and a side or the back of the dielectric substrate or are formed in the dielectric substrate, for example.

To form the first and second antenna elements 14 and 16 on one surface of the dielectric substrate 12, for example, a method of performing screen printing of silver paste as the shapes of the antenna elements 14 and 16 on the surface of the dielectric substrate 12 and then baking at a predetermined temperature can be used.

As described above, according to the invention, the first and second antenna elements 14 and 16 share a part of the wide parts 14*b* and 16*b*, so that the dimension W of the antenna 10 in the width direction thereof can be lessened. Since the second antenna element 16 is inclined at the predetermined angle θ with respect to the first antenna element 14, the electromagnetic interaction between the first and second antenna elements 14 and 16 can be decreased and the characteristics of the antenna elements 14 and 16 are not impaired. Particularly, the angle θ is set to a value in the range of 5° to 50°, so that 1000 MHz or more can be provided as the bandwidth in the 5-GHz band of the high-frequency side.

Figure 3:
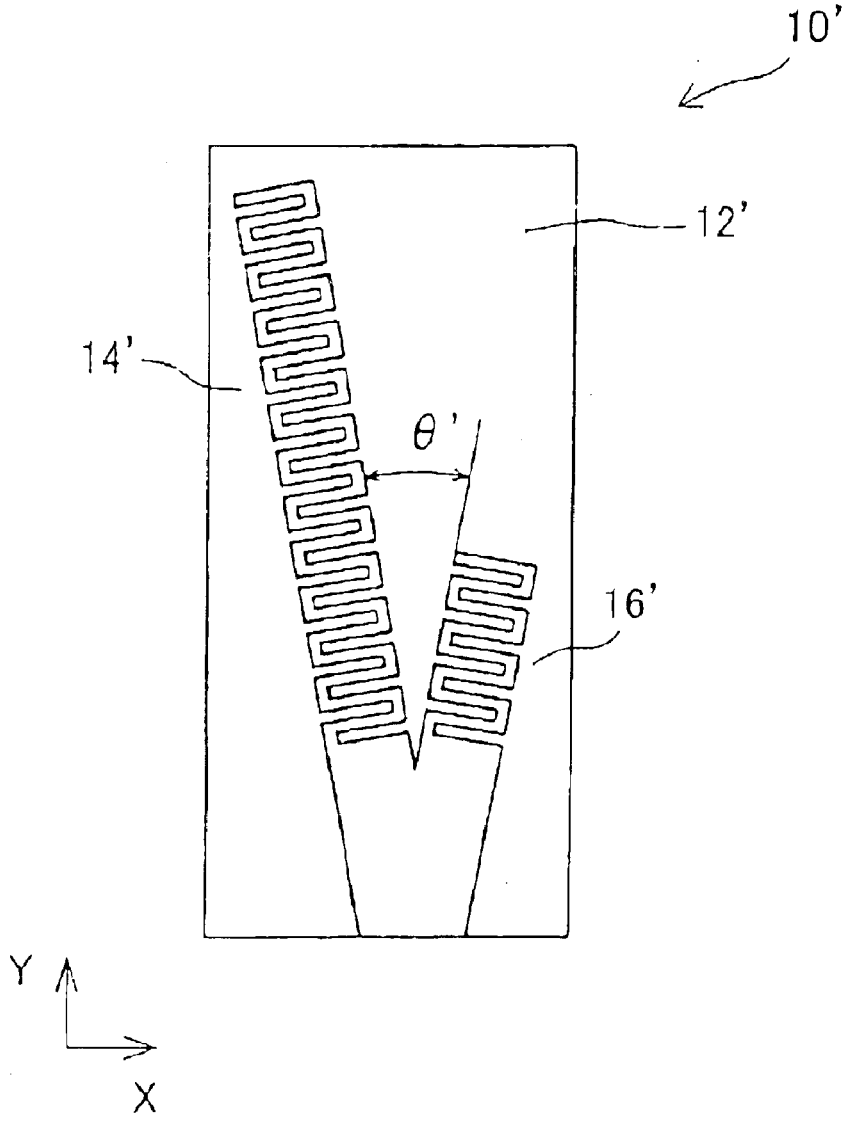
FIG. 3 is a plan view to show an antenna as a second embodiment of the invention.

Next, FIG. 3 is a plan view to show an antenna as a second embodiment of the invention. An antenna 10' of the embodiment differs from the antenna 10 of the first embodiment in that in the first embodiment, the first antenna element 14 is placed almost along the length direction of the dielectric substrate 12 and the second antenna element 16 is inclined relative to the first antenna element 14; while, in the second embedment, a first antenna element 14' is placed in a slanting position relative to the length direction (Y direction) of a dielectric substrate 12' and a second antenna element 16' is inclined relative to the first antenna element 14'. That is, the first and second antenna elements 14' and 16' are placed in slanting positions relative to the length direction (Y direction) of the dielectric substrate 12'.

In the second embodiment, as the antenna elements 14' and 16' are placed on the dielectric substrate 12' as described above, functions similar to those of the antenna of the first embodiment can be accomplished and similar advantages to those in the first embodiment can be provided.

Figure 4:
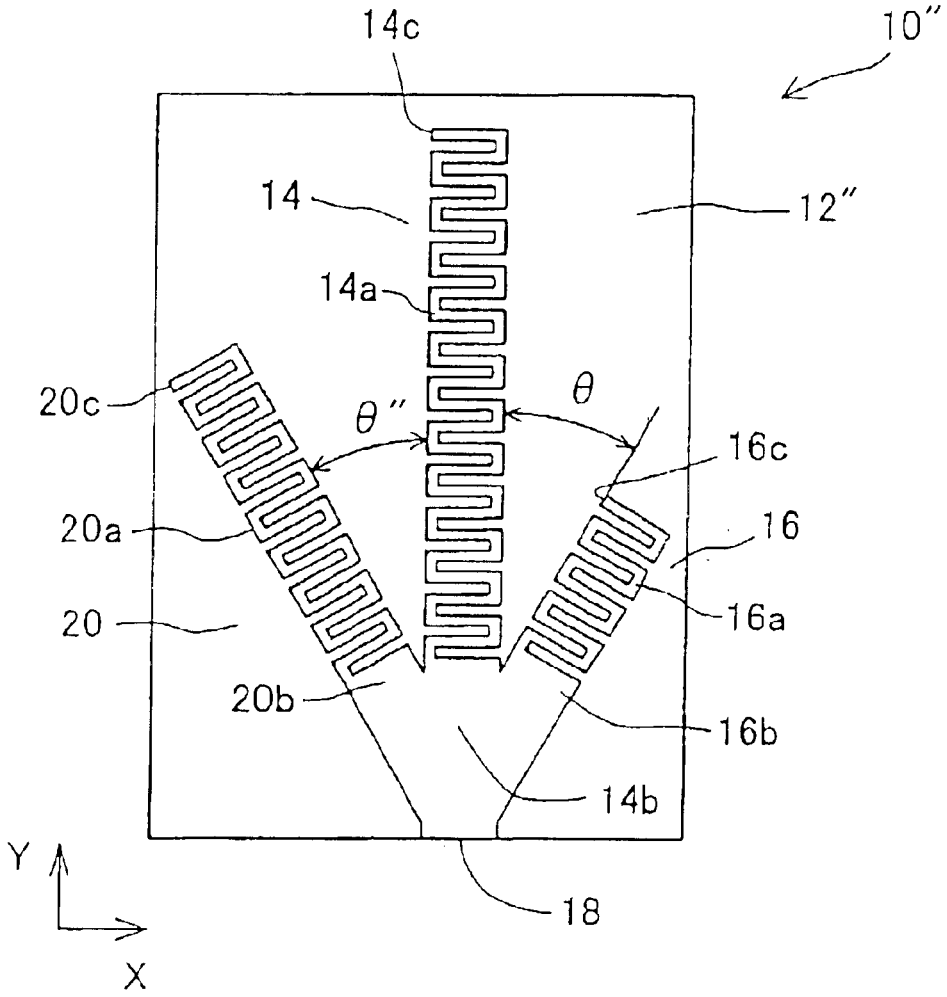
FIG. 4 is a plan view to show an antenna as a third embodiment of the invention.

Next, FIG. 4 is a plan view to show an antenna as a third embodiment of the invention. An antenna 10" of the embodiment differs from the antenna 10 of the first embodiment in that in the first embodiment, the antenna 10 includes the two antenna elements; while, the antenna 10" of the second embodiment includes three antenna elements. That is, the antenna 10" of the embodiment operates with three frequency bands systems as a third antenna element 20 is added to first and second antenna elements 14 and 16.

Like the first, second antenna element 14, 16, the added third antenna element 20 has an open end 20*c* as one end and a feeding end 18 as an opposite end. On the open end 20*c* side, a narrow part 20*a* is formed and on the feeding end 18 side, a wide part 20*b* is formed.

Like the second antenna element 16, the third antenna element 20 is inclined at a predetermined angle θ" with respect to the first antenna element 14 and in addition, the first, second, and third antenna elements 14, 16, and 20 have wide parts 14*b*, 16*b*, and 20*b* joined in one piece so as to share a part of the wide parts 14*b*, 16*b*, and 20*b*.

Like a narrow part 14*a*, 16*a* of the first, second antenna element 14, 16, the narrow part 20*a* of the third antenna element 20 forms a meander shape. Further, the third antenna element 20 is also formed on the same face of a dielectric substrate 12" as the first and second antenna elements 14 and 16 are formed.

Since the third antenna element 20 is thus configured, the antenna 10" of the embodiment basically can accomplish functions similar to those of the antenna of the first embodiment and can provide similar advantages to those in the first embodiment and further operates with three frequency bands systems.

The antenna 10, 10', 10" in the first to third embodiments described above is installed in a radio communication device in a wireless LAN, etc., as one component of a radio frequency module, for example.

Then, such a radio frequency module incorporating the antenna 10, 10' of the embodiment will be discussed briefly.

Figure 5:
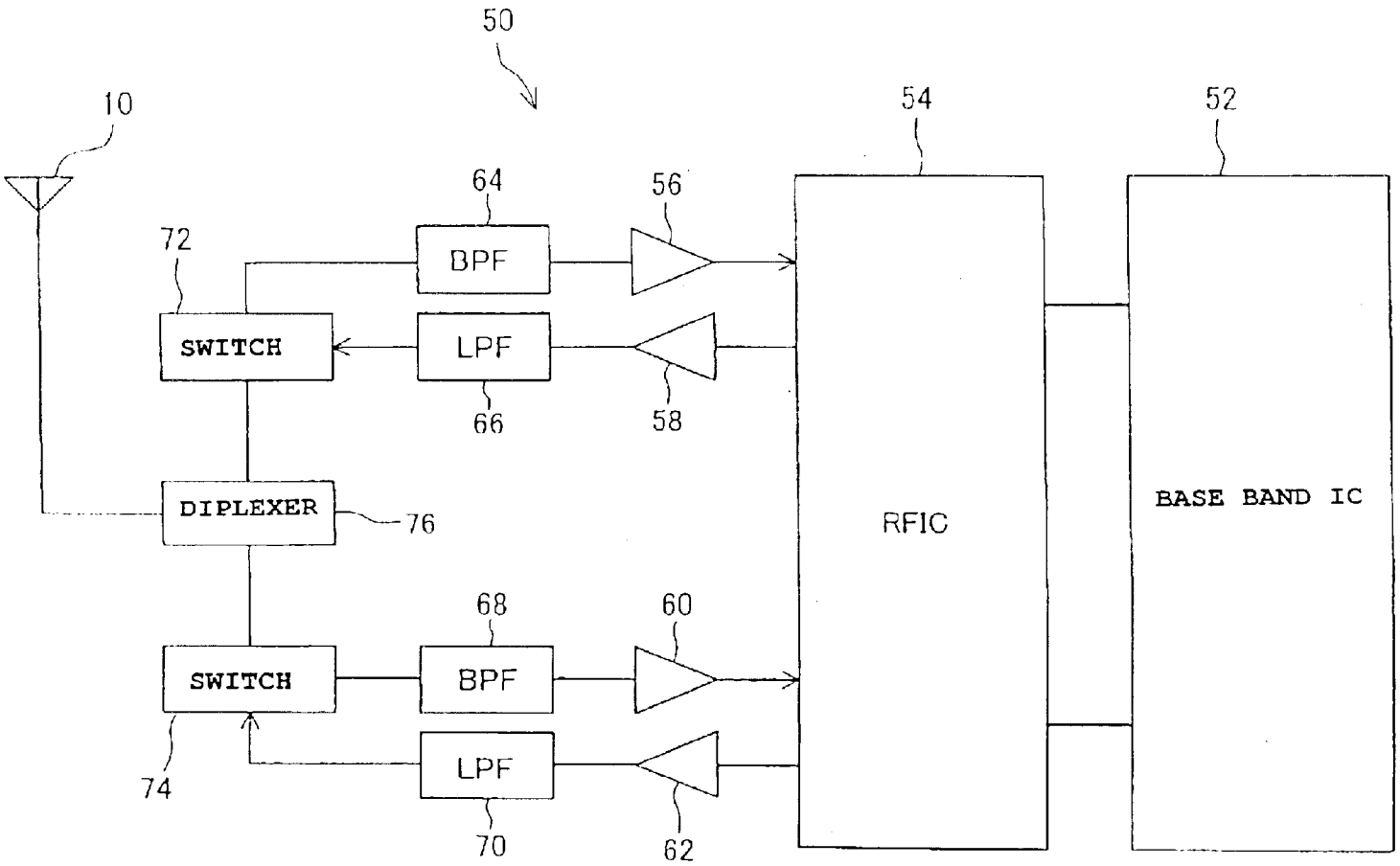
FIG. 5 is a block diagram to show the configuration of a radio frequency module incorporating the antenna 10 shown in FIG. 1.
Figure 6:
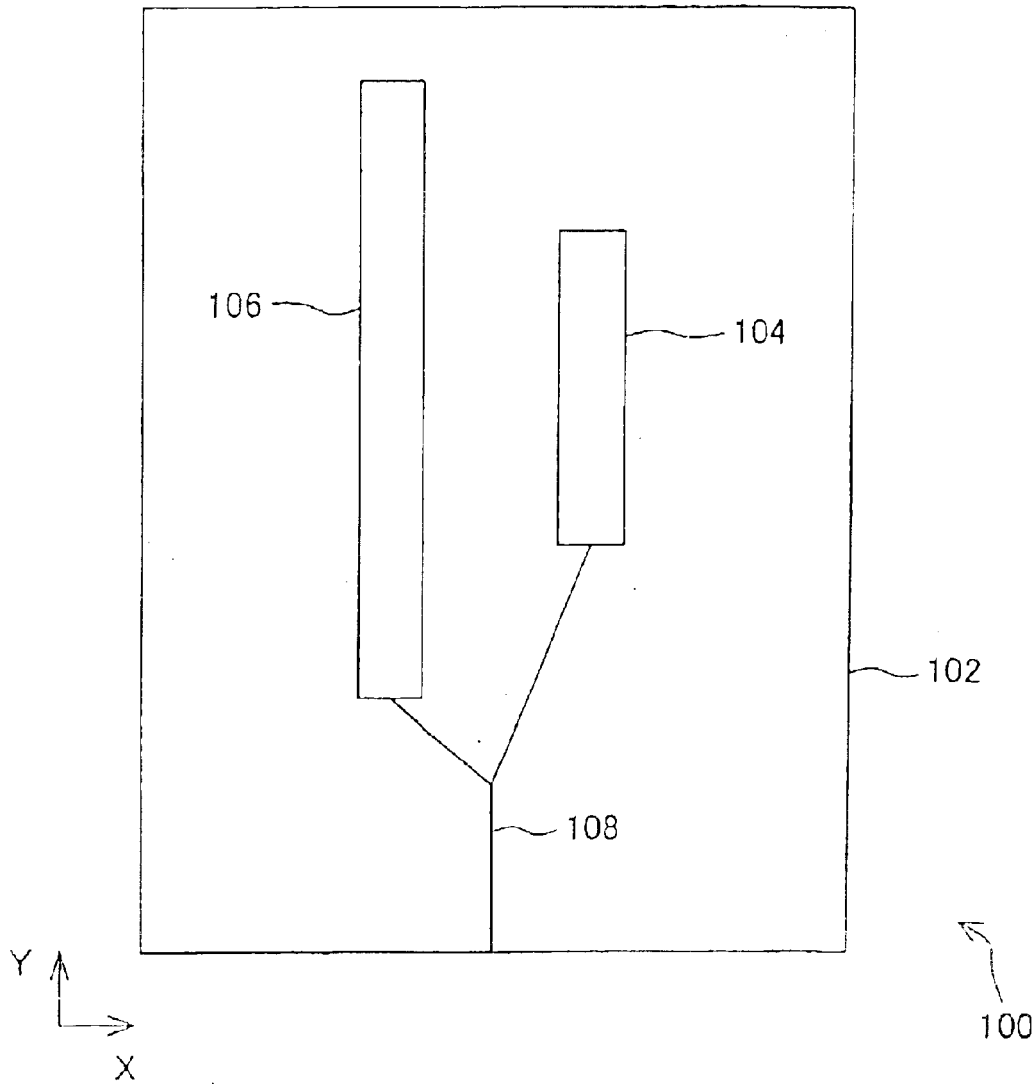
FIG. 6 is a plan view to show an example of a multi-band antenna in a related art.

FIG. 5 is a block diagram to show the configuration of a radio frequency module incorporating the antenna 10 in FIG. 1.

As shown in FIG. 5, a radio frequency module 50 includes a base band IC 52, a radio frequency (RF) IC 54, low-noise amplifiers 56 and 60, power amplifiers 58 and 62, band-pass filters (BPFs) 64 and 68, low-pass filters (LPFs) 66 and 70, switches 72 and 74, a diplexer 76, and the antenna 10 in FIG. 1. The low-noise amplifier 56, the power amplifier 58, the BPF 64, the LPF 66, and the switch 72 are a circuit for the 2.4-GHz band, and the low-noise amplifier 60, the power amplifier 62, the BPF 68, the LPF 70, and the switch 75 are a circuit for the 5-GHz band.

The base band IC 52 controls the RFIC 54 and transfers a low-frequency signal to and from the RFIC 54. The RFIC 54 converts a low-frequency transmission signal received from the base band IC 52 into a radio frequency signal and converts a radio frequency reception signal into a low-frequency signal and passes the low-frequency signal to the base band IC 52.

The diplexer 76 performs band switching between 2.4-GHz and 5-GHz bands. Specifically, to communicate in the 2.4-GHz band, the diplexer 76 connects the antenna 10 and the circuit for the 2.4-GHz band; to communicate in the 5-GHz band, the diplexer 76 connects the antenna 10 and the circuit for the 5-GHz band.

Each of the switches 72 and 74 switches the signal path in response to transmission or reception. Specifically, to receive a signal, the signal path on the BPF side is selected; to transmit a signal, the signal path on the LPF side is selected.

Therefore, for example, if communications are conducted in the 2.4-GHz band and the antenna 10 receives a signal, the reception signal is input through the diplexer 76 and the switch 72 to the BPF 64 and is subjected to band limitation through the BPF 64 and then the signal is amplified by the low-noise amplifier 56 and is output to the RFIC 54. The RFIC 54 converts the reception signal from the 2.4-GHz band to a low-frequency band and passes the conversion result to the base band IC 52.

In contrast, to transmit a signal through the antenna 10, a low-frequency transmission signal is passed from the base band IC 52 to the RFIC 54, which then converts the transmission signal from a low-frequency band to the 2.4-GHz band. The transmission signal is amplified by the power amplifier 58 and then the low-frequency band is cut through the LPF 66 and then the signal is transmitted from the antenna 10 through the switch 72 and the diplexer 76.

On the other hand, to communicate in the 5-GHz band, using the circuit for the 5-GHz band, processing involved in transmission and reception is performed according to a similar procedure to that of communications in the 2.4-GHz band, and a signal is transmitted and received using the same antenna 10 as used in the 2.4-GHz band.

It is to be understood that the invention is not limited to the specific embodiments thereof and various embodiments of the invention may be made without departing from the spirit and scope thereof. For example, at least part of each antenna element may be covered with an insulation layer. The insulation layer preferably comprises a ceramic which may be same as that of the dielectric substrate or a resin such as an epoxy resin and a phenol resin. The thickness of the insulation layer is not limited, but, preferably from 10 to 100 μm.

In the above-described embodiments, antenna-dedicated boards are used as the dielectric substrates 12, 12', and 12", but print circuit boards for mounting parts may be used in place of the dedicated boards. For example, to apply the antenna of the invention to a radio frequency module as shown in FIG. 5, the antenna elements making up the antenna of the invention may be formed in a partial area of the print circuit board on which a part or all of the radio frequency module is constructed.

In the embodiments, the case where the antenna is used with a radio communication device in a wireless LAN, etc., is described, but the antenna maybe used with a radio communication device in a mobile telephone, Bluetooth, etc.

In the embodiments, the antennas for operating with two or three frequency bands systems are described, but if the number of antenna elements is increased to four, five, or more, the antenna can operate with as many frequency bands systems as the number of antenna elements. In this case, the angle between one pair of the antenna elements may be the same as or different from the angle between another pair of the antenna elements.

This application is based on Japanese Patent application JP 2002-153733, filed May 28, 2002, the entire content of which is hereby incorporated by reference, the same as if set forth at length.

What is claimed is:

1. A multiple band antenna comprising:

a dielectric substrate; and a plurality of antenna elements being formed of each a conductor on a same face of the dielectric substrate and provided in a one-to-one correspondence with frequency bands to operate the frequency bands, wherein each of the antenna elements has an open end as one end and is connected at an opposite end to a feeder line and comprises a narrow part being placed on a side of the open end and formed by line with narrow width and a wide part being placed on a side of the feeder line and having a wider width than the narrow width of the narrow part, the narrow part is turned in order in substantially the same direction as a width direction of the wide part, to form a meander shape, and the antenna elements have the wide parts joined in one piece forming a predetermined angle with each other so as to share a part of the wide parts, the predetermined angle being between 5° or more and 50° or less, and the wide parts of each of the antenna elements functioning as an impedance matching part of the antenna elements.

2. The multiple band antenna according to claim 1, which operates with two frequency bands of a 2.4-GHz band and a 5-GHz band.

3. The multiple band antenna according to claim 1, wherein the dielectric substrate is a print circuit board for mounting parts.

4. The multiple band antenna according to claim 3, wherein the print circuit board mounts parts for a radio communication device.

5. The multiple band antenna according to claim 1, wherein at least one of the antenna elements is placed almost along a length direction of the dielectric substrate.

6. The multiple band antenna according to claim 1, wherein each of the antenna elements has a different line length.

7. A radio frequency module for transmitting and receiving a signal, comprising the multiple band antenna according to claim 1.

8. The radio frequency module according to claim 7, which further comprises a switch for switching a signal path in response to transmission or reception.

9. A multiple band antenna comprising:

a dielectric substrate; and a plurality of antenna elements being formed of each a conductor on a same face of the dielectric substrate and provided in a one-to-one correspondence with frequency bands to operate the frequency bands, wherein each of the antenna elements has an open end as one end and is connected at an opposite end to a feeder line and comprises a narrow part being placed on a side of the open end and formed by line with narrow width and a wide part being placed on a side of the feeder line and having a wider width than the narrow width of the narrow part, the narrow part is turned in order in substantially the same direction as a width direction of the wide part, to form a meander shape, and the antenna elements have the wide parts joined in one piece forming a predetermined angle with each other so as to share a part of the wide parts, and the wide parts of each of the antenna elements functioning as an impedance part for the antenna elements, and all of the antenna elements being placed in a slanting position relative to a length direction of the dielectric substrate.

10. The multiple band antenna according to claim 9, which operates with two frequency bands of a 2.4-GHz band and a 5-GHz band.

11. The multiple band antenna according to claim 9, wherein the dielectric substrate is a print circuit board for mounting parts.

12. The multiple band antenna according to claim 11 wherein the print circuit board mounts parts for a radio communication device.

13. The multiple band antenna according to claim 9, wherein each of the antenna elements has a different line length.

14. A radio frequency module for transmitting and receiving a signal, comprising the multiple band antenna according to claim 9.

15. The radio frequency module according to claim 14, which further comprises a switch for switching a signal path in response to transmission or reception.

* * * * *